US005184909A

United States Patent [19]

Schaefer

[11] Patent Number: 5,184,909

[45] Date of Patent: Feb. 9, 1993

[54] DISPENSER FOR SEALANTS WITH SPECIFIC BRISTLE ARRANGEMENT

[75] Inventor: William L. Schaefer, Wilmette, Ill.

[73] Assignee: Fel-Pro Incorporated, Skokie, Ill.

[21] Appl. No.: 828,787

[22] Filed: Jan. 30, 1992

[51] Int. Cl.[5] ..... A46B 11/00; A46B 11/02

[52] U.S. Cl. ..... 401/268; 401/5; 401/288; 401/269

[58] Field of Search ..... 401/288, 28, 268, 269, 401/262, 5

[56] References Cited

U.S. PATENT DOCUMENTS 2,075,964 4/1937 Teigeler ..... 401/28 X
4,279,527 7/1981 Moe et al. .
4,348,126 9/1982 Nigro .
4,786,199 11/1988 Chen .
4,789,261 12/1988 Iwase et al. .
4,902,152 2/1990 Seidler .
4,908,902 3/1990 McNab et al. .
4,974,984 12/1990 Kafkis et al. ..... 401/288 X
5,066,157 11/1991 Liff .

FOREIGN PATENT DOCUMENTS 477236 10/1969 Fed. Rep. of Germany ..... 401/268
3518709 11/1986 Fed. Rep. of Germany ..... 401/288

*Primary Examiner*—Steven A. Bratlie
*Attorney, Agent, or Firm*—Dressler, Goldsmith, Shore, Sutker & Milnamow, Ltd.

[57] ABSTRACT

A dispenser for a container of pipe sealant and the like comprising a dispensing closure for preventing the lateral spread of a compound contained by the container as it is dispensed and having a bristle assembly which prevents removal of the compound after it has been deposited and spread between the threads of a pipe.

6 Claims, 1 Drawing Sheet

Fig. 1
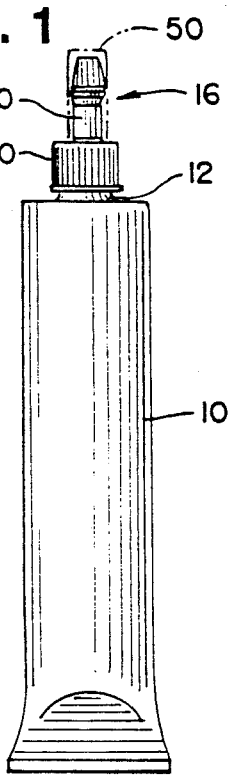
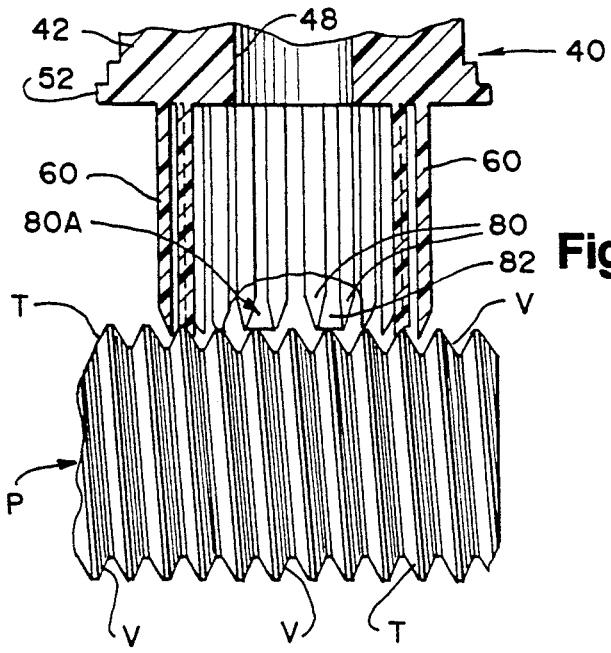
Fig. 5
Fig. 3
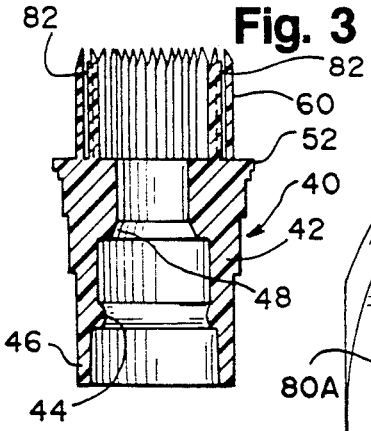
Fig. 4
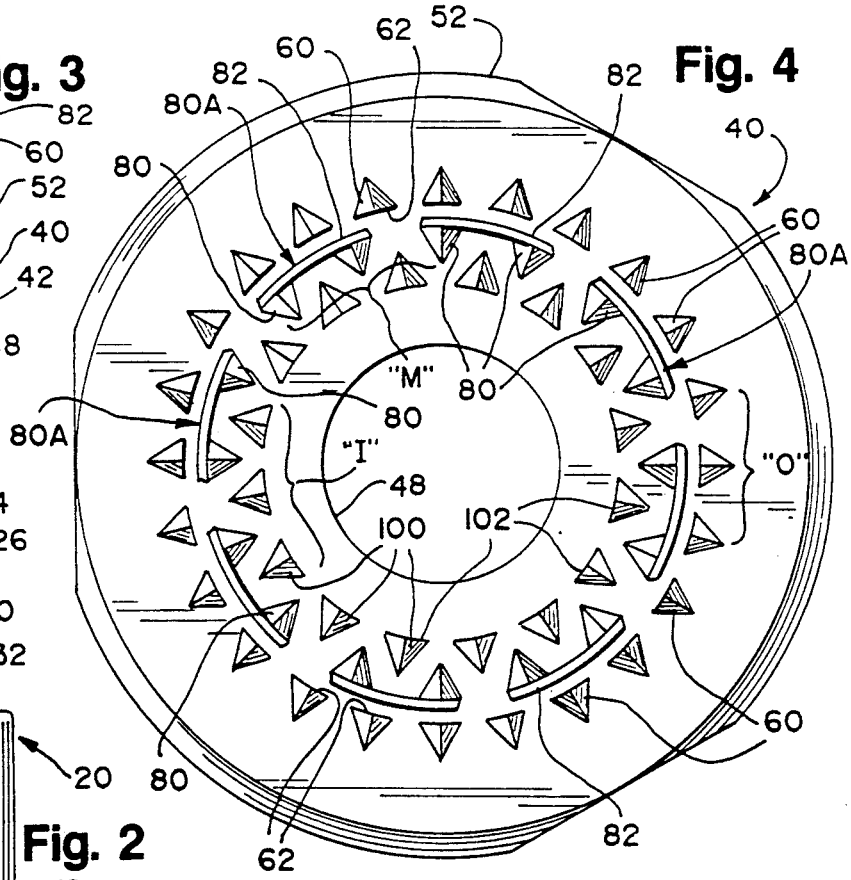
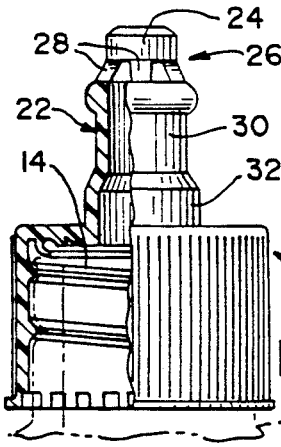
Fig. 2

DISPENSER FOR SEALANTS WITH SPECIFIC BRISTLE ARRANGEMENT

BACKGROUND OF THE INVENTION

A wide variety of sealants, lubricants, adhesives and the like compounds or products which are typically viscous rather than free-flowing, are dispensed from deformable containers such as tubes onto surfaces where they need to be applied, spread, and distributed appropriately. Most such tubes simply permit dispensing of a stream or ribbon of such a compound, which then requires spreading or distribution by finger or by an auxiliary brush.

In the past suggestions have been made to use tubes with applicator/spreaders associated with them. However, applicator/spreaders, such as those which make use of traditional bunched bristle assemblies distributed as in a circular array, are unsuitable for a number of reasons, including the fact that they permit the compound to escape laterally outwardly through and between the bristles and because they tend to remove the spread compound from the areas to which the compound is applied. A typical bunched bristle assembly applicator which has been suggested for cosmetic use and which would present such a problem, and which therefore is representative of the prior art problems, is illustrated in FIGS. 1-3 of U.S. Pat. No. 5,066,157.

It would be of advantage to provide an improved applicator/spreader for applying, distributing and spreading relatively viscous compounds from deformable tubes which does not have the disadvantages and drawbacks of the prior art.

SUMMARY OF THE INVENTION

An improved applicator/spreader in accordance with this invention comprises a dispenser assembly including a deformable container having a neck through which the contents of the container may be expressed, and an applicator/spreader secured to the neck. The applicator/spreader defines a passageway and has a body defining an opening through which the container contents may pass outwardly. The body has a bristle assembly which is integrally formed therewith. The bristle assembly surrounds, and is in flow communication with, the opening. The bristle assembly comprises at least two closely spaced rows of upstanding bristles, one row surrounding the other row, each row of bristles comprising a plurality of bristles, each of which tapers to a point at its free end. Thus each is wider at its base and zone of formation with the body than at its outer tip. The bristles in one row are in a staggered array with the bristles in the next adjacent rows, thereby to resist the flow of the container contents laterally outwardly of the bristle assembly adjacent the bases of the bristles.

Preferably the tapered bristles are triangular in cross-section and the outermost row of bristles has the base of the triangle facing inwardly, although the bristles may be of other cross-sectional configurations as well, such as oval, rectangular, etc. Desirably the bristles of two adjacent rows are interdigitated and one of the rows of bristles has adjacent pairs of adjacent bristles connected by webs. In one form of the invention, there are three concentric rows of bristles and the web-connected bristles constitute the middle row of bristles.

Desirably one of the rows of bristles has bristles which are wider and stiffer than the bristles of the other rows.

In a preferred form the applicator/spreader comprises a dispensing closure including a threaded member secured to the neck, the body is mounted for reciprocation on the threaded member between a closed position and an open position, and the bristle assembly comprises at least three concentric rows of bristles. Desirably at least one of the rows of bristles is modified to have bristles which are wider and stiffer than the bristles of the other rows. In one form the bristles may be triangular in cross-section and the outermost row of bristles has the base of the triangle facing inwardly. The bristles of two adjacent rows are preferably interdigitated. The middle row of bristles may be stiffer and wider, as by interconnecting adjacent pairs of bristles.

Further objects, features and advantages of the present invention will become apparent from the following description and drawings.

BRIEF DESCRIPTION OF THE DRAWINGS

FIG. 1 is a side elevational view of a dispenser and closure assembly of the present invention;

FIG. 2 is an enlarged cross-sectional view of a portion of the closure assembly of FIG. 1;

FIG. 3 is a cross-sectional view of a further portion of the closure assembly of FIG. 1;

FIG. 4 is a enlarged plan view of the portion of the closure assembly shown in FIG. 3; and FIG. 5 is an illustrative view, partially broken away and partially in section, showing the use of the dispenser and closure assembly of FIG. 1 in applying a compound to the threads of a pipe.

DETAILED DESCRIPTION

Referring first to FIGS. 1 to 4, a dispenser assembly of the present invention may comprise a container such as a tube 10 which may be deformed, as by squeezing, to force the relatively viscous contents outwardly through its neck 12. The neck 12 may be threaded with conventional threads to which an applicator/spreader dispensing closure assembly 16 having complementary threads 14 is secured.

Closure assembly 16 may be of the push-down/pull-up type as best illustrated by FIGS. 2 and 3. As there shown the threaded base 20, which may be of a plastic material such as polypropylene, defines a hollow, outwardly projecting post 22. The end of the post 22 defines a sealing plug 24 below which an open cage 26 is provided. The cage comprises a plurality of upstanding struts 28 to support the sealing plug 24. The post 22 also defines a lower cylinder zone 30 of reduced diameter.

The threaded base mounts a dispenser tip body 40 which may be of a plastic material such as polyethylene. Dispenser tip body 40 is hollow and includes a lower mounting section 42 which is proportioned and mounted for reciprocating movement on post 20. The lower section 42 defines an annular, inwardly projecting ring 44 which is disposed within cylindrical zone 30 and which is adapted to reciprocate within zone 30. The lower end 46 of the section 42 is of an inner diameter similar in size and shape to the outer diameter of the lower portion 32 of post 22 to assist in stabilizing the dispenser tip 40 as it reciprocates on post 22.

When the tip body 40 is in its lowermost position relative to post 22, the reduced diameter opening 48 adjacent the dispensing end of the tip body 40 is plugged or closed by sealing plug 24. However, when the tip 40 is reciprocated outwardly, opening 48 is open for flow from the mouth of the tube via the cage 26 so that the tube contents may be discharged outwardly therethrough for application as desired. A readily removable protective overcap 50 may also be provided. Overcap 50 is adapted to be frictionally seated on the dispensing closure assembly, as by frictional engagement with the upper edge 52 of the dispenser tip body 40.

The upper end of the dispenser tip body 40 is provided with an integrally formed or molded brush or bristle assembly which is structured and arrayed to prevent lateral spread of the compound contained in tube 10 as it is dispensed, as well as to minimize removal of the spread compound after it has been applied and spread as desired. To that end the tip body 40 is integrally formed with a plurality of individual bristles arrayed in at least two, and preferably at least three, closely spaced concentric circular row "O" of upstanding bristles. In the embodiment illustrated the outer row has a plurality of tapering bristles 60 which, in the illustrated embodiment, are triangular in cross-section (see FIG. 4) and pyramidal in side elevation. The triangular cross-section has its apex pointing outwardly with, of course, the base 62 of the triangle facing inwardly. The outer row of bristles is at least three eighths inch to about one-half inch high, is about 0.04 inch wide at its base and zone of formation with the body, and is spaced about 0.02 inch from each adjacent bristle.

The middle row "M" of bristles has bristles which are effectively wider and stiffer than those of the other rows. In the illustrated embodiment the bristles 80 of the middle row are shaped similarly to bristles 60, but with the apices facing inwardly. The bristles 80 are spaced from each other at their bases by a distance somewhat greater than the spacing of bristles 60. In the case of the middle row, to provide for wider and stiffer bristles, pairs of adjacent bristles are joined, as by a web 82 which extends substantially the full height of the bristles 80. Thus pairs of bristles are effectively joined to form an integrated bristle 80A which is wider and stiffer than bristles 60, 80 and 100.

The bristles 100 of the inner row I again are similar in size and shape, and in their spacing from each other, to the bristles of the outer row O. They also have their apices facing outwardly, with the faces of the bases 102 facing inwardly.

As will be apparent from FIG. 4, any compound moving radially or laterally outwardly from opening 48 encounters the staggered array of the rows I, M and O of bristles, including the broad faces or bases 102 of the bristles 100 of row I, the reduced spaces between the confronting surfaces of interdigitated bristles 80 and 100, the baffle provided by the joined bristles 80 and webs 82, and the broad faces or bases 62 of bristles 60 of row O. Thus, the staggered bristle array baffles and resists the flow of the container contents laterally outwardly adjacent the bases of the bristles where they are joined with the tip body 40. When the brush assembly is laid and pressed against a surface to which the compound is to be applied, the spaces between the bristles are further reduced, thereby further restricting the lateral flow of the compound adjacent the bases of the bristles. As such, the bristle assembly described promotes discharge of the compound axially, namely axially outwardly to the tip ends of the bristles, generally as would occur if the bristles constituted a closed cylindrical tube.

FIG. 5 illustrates the use of the applicator assembly in accordance with this invention in a typical environment of use, namely the application of a compound, such as a sealant, to be deposited and spread on the threads T of a pipe P to be joined to a fitting. In such a case, it is desirable to deposit and spread the compound between the pipe threads. It is important that the compound, once deposited and spread therein, not be removed. Typical brush and bristle assemblies, such as those illustrated by U.S. Pat. No. 5,066,157, will not only permit excessive spread of compound laterally through the bristles, but the trailing bristles will also tend to remove the compound from between the threads after the compound has been deposited.

With the bristle construction described herein, particularly when at least one row comprises bristles which have effectively been widened to a dimension which is at least about as great as the distance between the adjacent peaks of an adjacent pair of threads, the trailing bristles will tend to be prevented from descending down into the valleys V between the peaks, hence will prevent the brush assembly from removing the deposited, spread compound. The pairs of bristles 80 with their associated web 82 are approximately 0.085 inch in width. This is substantially as great as the widths of the valleys V of standard pipe threads on pipes of from one-eighth inch (0.037 inch distance between adjacent threads) up to two inches (0.087 inch distance between adjacent threads) in diameter, and therefore is universal to pipes in that range of diameters.

From the foregoing, it will be apparent to those skilled in the art that modifications may be made without departing from the spirit and scope of the invention. Accordingly, it is intended that the invention be considered as not being limited, except as may be necessary in light of the appended claims.

What is claimed is:

1. A dispenser assembly including a deformable container having a neck through which the contents of the container may be expressed, and an applicator/spreader secured to the neck, said application/spreader defining a passageway and having a body defining an opening through which the container contents may pass outwardly, said body having a bristle assembly integrally formed therewith, said bristle assembly surrounding, and being in flow communication with, said opening, said bristle assembly comprising at least two closely spaced rows of upstanding bristles, one row surrounding the other row, each row of bristles comprising a plurality of tapering bristles each of which is wider at its base and zone of formation with said body than at its outer tip, the bristles in one row being in staggered array with the bristles in the next adjacent rows to resist the flow of the container contents laterally outwardly of the bristle assembly adjacent the bases of the bristles and wherein the bristles of one row are effectively wider adjacent their outer tips than are the bristles of the other rows to prevent the outer tips of the other rows from descending into spaces between thread peaks, so that when the dispenser assembly is applying its contents to pipe threads, the contents are spread between the threads and are not wiped out therefrom.

2. A dispenser assembly in accordance with claim 1, and wherein in the one row of bristles, pairs of adjacent bristles are connected.

3. A dispenser assembly in accordance with claim 2, and wherein there are three concentric rows of bristles and wherein said one row of connected bristles constitutes the middle row of bristles.

4. A dispenser assembly in accordance with claim 1, and wherein all of the bristles are of substantially the same length.

5. A dispenser assembly in accordance with claim 1, and wherein said one row of bristles has bristles which are both substantially wider and stiffer than the bristles of the other rows.

6. A dispenser assembly in accordance with claim 1, and wherein the applicator/spreader comprises a dispensing closure including a threaded member secured to the neck, wherein said body is mounted for reciprocation on said threaded member between a closed position and an open position, and wherein said bristle assembly comprises at least three concentric rows of bristles.

* * * * *